US005395144A

United States Patent [19]

Galindo

[11] Patent Number: 5,395,144

[45] Date of Patent: Mar. 7, 1995

[54] NON-HANDED DOOR LATCH FOR PASSAGE AND PRIVACY FUNCTIONS

[75] Inventor: Jaime Galindo, Hayward, Calif.

[73] Assignee: Schlage Lock Company, San Francisco, Calif.

[21] Appl. No.: 56,001

[22] Filed: May 3, 1993

[51] Int. Cl.[6] ..... E05C 1/08

[52] U.S. Cl. ..... 292/169.16; 292/1.5

[58] Field of Search ..... 292/169.16, 1.5, 150, 292/169.21, 169.22

[56] References Cited

U.S. PATENT DOCUMENTS

| | | | |
|---|---|---|---|
| 4,615,549 | 10/1986 | Couture | 292/169.21 |
| 4,708,379 | 11/1987 | Ching | 292/1.5 |
| 4,736,973 | 4/1988 | Fang | 292/1.5 X |
| 4,950,008 | 8/1990 | Fang | 292/1.5 X |
| 4,997,220 | 3/1991 | Jans | 292/169.16 |
| 5,074,605 | 12/1991 | Fann et al. | 292/1.5 X |
| 5,102,175 | 4/1992 | Wu et al. | 292/169.21 X |

*Primary Examiner*—Philip C. Kannan

*Attorney, Agent, or Firm*—Robert F. Palermo

[57] ABSTRACT

A door latch for passage and privacy applications provides capability for non-handed installation as well as independent bolt operating cams which may be selectively locked or may be unlocked by retraction of the bolt or by pushing the bolt inward when the door is closed. The latch also provides for removal of the bolt from the latch assembly when the faceplate is not attached. Dual backset capability is provided by means of telescopic forward housings and bolt-to-drawbar assemblies which may be placed in two indexable positions to adjust the length.

15 Claims, 1 Drawing Sheet

NON-HANDED DOOR LATCH FOR PASSAGE AND PRIVACY FUNCTIONS

BACKGROUND OF THE INVENTION

This invention relates generally to door locks and more particularly to door locks for passage and privacy functions.

Interior doors of buildings are equipped with latch assemblies often having a locking capability. A locking capability is generally desirable in doors used on bathrooms, bedrooms, and other areas where limited privacy is desired. Closets and hallways usually do not require a privacy locking capability.

During construction, handing of doors is an important consideration affecting comfort and convenience within the building. Whether a door swings inwardly or outwardly and is hinged on the right side or the left side, it will affect the necessary handing of the latch assembly to be installed. Privacy locking capability must also be appropriately oriented regardless of handing or direction of door swing. In addition, backset distance must also often be accounted for. Since standard door preparations include both $2\frac{3}{8}''$ and $2\frac{3}{4}''$ backset distances, this must also be considered along with the previously described locking and handing requirements.

Depending upon the size of a building, its purpose, and the styling options which are chosen, it is clear that the potential number of different latch assembly options required for different locations is very large. This large number of options increases proportionately the potential for supply errors, inappropriate installations, delayed installations, and losses associated with replacement of erroneously installed latch assemblies.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a door latch providing non-handed installation capability for passage and privacy applications, including a latch housing having a rear portion and a forward portion, the forward portion having provision for attaching a faceplate; a bolt and drawbar assembly; two independent cams mounted in the rear portion of the housing for independently operating the drawbar to retract the drawbar and bolt assembly; provision for locking either of the two independent cams; and provision for biasing the bolt and drawbar assembly to an extended position relative to the housing.

The foregoing and other aspects will become apparent from the following detailed description of the invention when considered in conjunction with the accompanying drawing figures.

DETAILED DESCRIPTION

Figure 1:
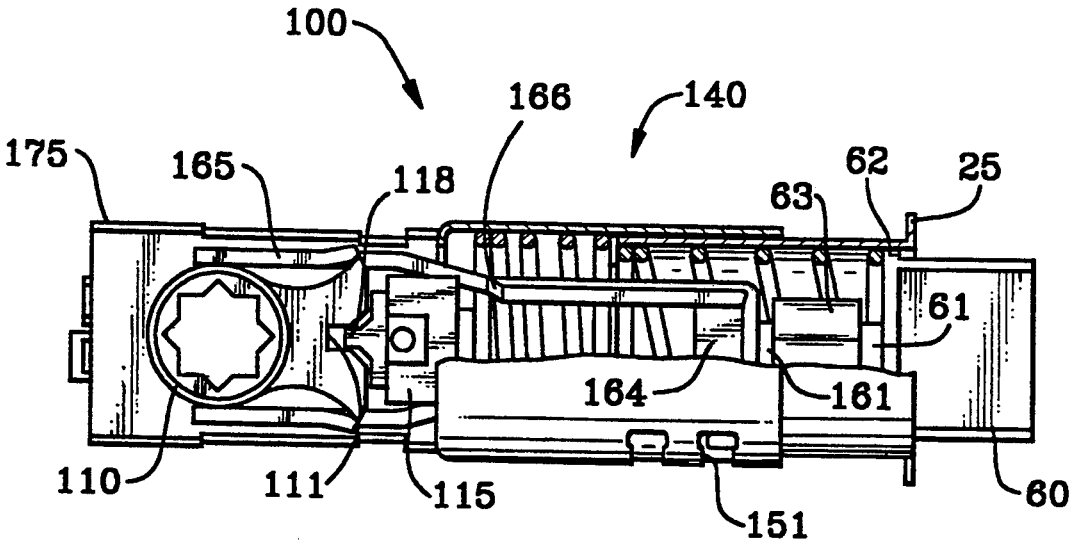
FIG. 1 is a fragmentary sectional elevation view showing a preferred embodiment of the latch assembly of the present invention.

Referring to FIG. 1, it is seen that a door latch assembly 100 according to the present invention consists of a housing with a rear portion 175, a forward portion 140, the forward portion having tabs 25 (or ears) for mounting a faceplate. Within rear portion 175 of the housing, cam 110, locking plate 115, and drawbar link 165 are seen. Note that there are two cams but only one can be seen in this view, and drawbar link 165 is found both above and below cam 110. Note also that the door latch assembly 100 shown here is :symmetric about an imaginary horizontal center plane in FIG. 1. "U" shaped drawbar link 165 extends within forward portion 140 to connect with bolt 60 by registering with groove 161 or 61 between bolt bosses 164 and 63 or boss 63 and bolt stop ring 62.

Figure 2:
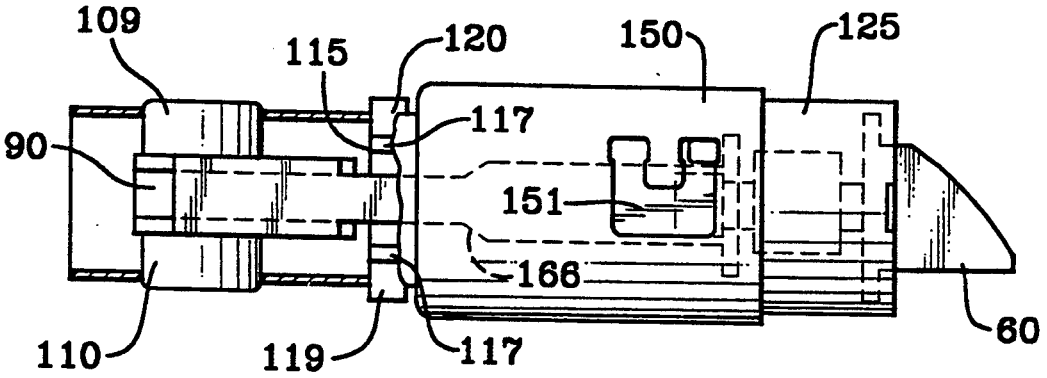
FIG. 2 is a fragmentary sectional plan view of the embodiment of FIG. 1.
Figure 3:
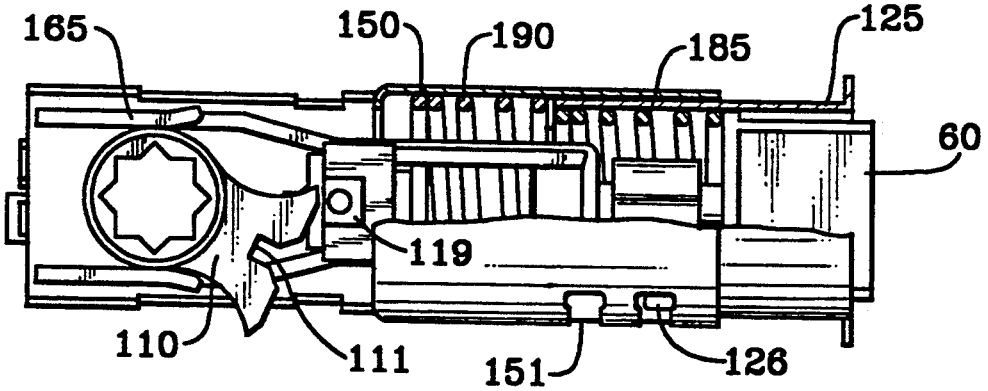
FIG. 3 is a fragmentary sectional elevation view showing the bolt assembly of FIG. 1 in its retracted position.

FIGS. 1 to 3, considered together, provide a clear demonstration of features of construction and function of the preferred embodiment. Rear portion 175 of the latch housing contains independent cams 109 and 110 separated by cam spacer 90. Cam lock 115 is mounted forward of cams 109 and 110 and can be moved transversely within the housing by pushing lock pin 119 or 120. If pin 119 is pushed, cam lock 115 moves such that lock tongue 118 becomes engaged with cam slot 111 of cam 110 to immobilize the cam. Independent cam 109, however, is still operable; and, when cam 109 is turned to retract bolt 60, drawbar link 165 retracts, and cam surface 166 of link 165 engages guide 117 of locking plate 115 and moves it to a centered, or unlocked, position so that both cams 109 and 110 are again free to operate. The same action between cam surface 166 of drawbar link 165 and guide 117 of lockplate 115 results when bolt 60 is pushed back into the housing, for example, when the door is being closed. When a faceplate is in place, extension of bolt 60 is limited by bolt stop ring 62.

Forward portion 140 of the housing is composed of outer housing 150 and inner housing 125. Inner housing 125 telescopes within outer housing 150 in order to accommodate the $\frac{3}{8}''$ difference between $2\frac{3}{4}''$ and $2\frac{3}{8}''$ backset distances. Bolt 60 is also adapted to accommodate that difference.

Since inner housing 125 telescopes within outer housing 150, a bias spring 190 is provided to maintain a bias between the inner forward face of outer housing 150 and the rear face of inner housing 125. Spring 185 biases bolt 60 to extend from inner housing 125 so that, unless retracted by action of cams 109 or 110 and link 165, bolt 60 remains extended. The dual backset capability described is provided by slots 161 and 61 which lie between rearward bolt boss 164 and center bolt boss 63, and the rear face of bolt stop ring 62 and center bolt boss 63, respectively. Boss 164 is oriented with its long flat faces parallel to the long elevation face of bolt 60, while boss 63 is axially turned to a 45 degree offset from the bolt boss 164 and the bolt face. Since the opening in the forward portion of link 165 has its long dimension oriented transversely with respect to that of boss 164 when in the operating position, and since motion of link 165 between grooves 161 and 61 only requires a 45 degree rotation in order to pass center bolt boss 63 through the opening of link 165, it can be seen that bolt 60 is secured to link 165 under operating conditions of the assembly.

Inner housing 125 has a boss 126 which protrudes slightly through slot 151 of outer housing 150. Slot 151 is substantially "U" shaped with its legs axially spaced by ⅜" center to center, and a circumferential extent of 45 degrees. Boss 126 and slot 151 guide the rotation and telescoping movements of inner housing 125, outer housing 150, and bolt 60. This 45 degree rotational limitation prevents disconnection of bolt 60 when the faceplate is in place.

The door latch of the present invention with all of the versatility embodied therein, provides almost universal application capability for passage and privacy applications.

What is claimed is:

1. A door latch for passage and privacy applications, providing non-handed installation capability, comprising:

a latch housing having a rear portion and a forward portion, said forward portion having means for attaching a face plate;

a bolt and drawbar assembly;

two independent cams mounted in said rear portion of said housing for independently operating said drawbar and bolt assembly;

means for locking either of said two independent cams, said means for locking comprising a locking plate having a locking tongue and capable of moving transversely within said housing to bring said locking tongue into engagement with a slot on either of said independent cams; and means for biasing said bolt and drawbar assembly to an extended position relative to said housing.

2. The door latch of claim 1, wherein said locking plate may occupy a locking position in which the locking tongue is engaged with the slot of either of said independent cams or may be in a neutral position in which the locking tongue is engaged with neither of the independent cams.

3. The door latch of claim 1, wherein the locking plate has protrusions extending outwardly from said housing, said protrusions enabling said locking plate to be pushed transversely in said housing to bring the locking tongue into or out of engagement with the slot on either independent cam.

4. The door latch of claim 3, wherein the locking plate has protrusions extending outwardly from said housing, said protrusions enabling pushing of said locking plate sideward to bring the locking tongue into a neutral position in which it engages neither independent cam.

5. The door latch of claim 1, further comprising:

means for unlocking said independent cams When said bolt is either pushed in or retracted.

6. The door latch of claim 5, wherein the means for unlocking said independent cams comprises means disposed upon said locking plate for moving said locking plate into a neutral position when acted upon by lateral cam surfaces of said drawbar when said bolt and drawbar assembly is either pushed in or retracted.

7. A door latch for passage and privacy applications, providing dual backset non-handed installation capability, comprising:

a latch housing having a rear portion and a forward portion, said forward portion having means for attaching a face plate and having an outer housing and inner housing, said inner housing nesting indexably and telescopically within said outer housing;

a bolt and drawbar assembly having means for selectively adjusting the bolt and drawbar assembly to one of two desired lengths, said means for adjusting comprising a shaped slot on a forward surface of said drawbar, said slot permitting a congruently shaped boss of said bolt, when rotated to a first position, to be moved in an axial direction with respect to said drawbar such that said shaped slot of said drawbar engages a circumferential groove in one of two indexable positions;

two independent cams mounted in said rear portion of said housing for independently operating said drawbar to extend and retract said bolt and drawbar assembly;

means for locking either of said two independent cams; and means for biasing said bolt and drawbar assembly to an extended position relative to said housing.

8. The door latch of claim 7, wherein the means for locking either of said two independent cams comprises a locking plate having a locking tongue and capable of movement transversely within said housing to bring said locking tongue into engagement with a slot on either of said independent cams.

9. The door latch of claim 8, wherein the locking plate has protrusions extending outwardly from said housing, said protrusions being used for pushing said locking plate sideward to bring the locking tongue into or out of engagement with the slot on either independent cam.

10. The door latch of claim 8, wherein said locking plate may occupy a locking position in which the locking tongue is engaged with the slot of either of said independent cams or may occupy a neutral position in which the locking tongue is engaged with neither of the independent cams.

11. The door latch of claim 10, wherein the locking plate has protrusions extending outwardly from said housing, said protrusions being used for pushing said locking plate sideward to bring the locking tongue into or out of engagement with the slot on either independent cam or into said neutral position.

12. The door latch of claim 10, further comprising:

means for unlocking said independent cams when said bolt is pushed in or retracted.

13. The door latch of claim 12, wherein the means for unlocking said independent cams comprises interactive means disposed upon said locking plate and upon said drawbar for moving said locking plate into said neutral position when the bolt and drawbar assembly is either pushed in or retracted.

14. The door latch of claim 7, further comprising:

means for separating said bolt from said drawbar.

15. The door latch of claim 14, wherein the means for separating said bolt from said drawbar comprises a boss on said bolt, said boss having an irregular shape and lying between an axially rearward end of said bolt and the rearmost of two circumferential grooves defining two indexably related positions of said bolt with respect to said drawbar, said boss having a shape such that, when rotated to a disengagement position, said bolt may be axially installed in or separated from said drawbar by passing said boss through a congruently shaped slot on the forward surface of said drawbar.

* * * * *